US010928756B1

(12) United States Patent
Araki

(10) Patent No.: US 10,928,756 B1
(45) Date of Patent: Feb. 23, 2021

(54) IMAGE FORMING DEVICE, IMAGE FORMING SYSTEM, IMAGE FORMING METHOD, AND NON-TRANSITORY RECORDING MEDIUM STORING IMAGE FORMING PROGRAM

(71) Applicant: TOSHIBA TEC KABUSHIKI KAISHA, Tokyo (JP)

(72) Inventor: Satoshi Araki, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/807,464

(22) Filed: Mar. 3, 2020

(51) Int. Cl.
*G03G 15/20* (2006.01)

(52) U.S. Cl.
CPC ..... *G03G 15/2039* (2013.01); *G03G 15/2017* (2013.01); *G03G 15/2053* (2013.01)

(58) Field of Classification Search
CPC ..... G03G 15/2017
See application file for complete search history.

(56) References Cited

U.S. PATENT DOCUMENTS

2014/0270836 A1* 9/2014 Chosokabe ..... G03G 15/5091 399/70
2016/0246225 A1* 8/2016 Yamada ..... G03G 15/2046

FOREIGN PATENT DOCUMENTS

| | | |
|---|---|---|
| JP | 6-35365 | 2/1994 |
| JP | 2005-043821 | 2/2005 |
| JP | 2016-071318 | 5/2016 |

* cited by examiner

*Primary Examiner* — Victor Verbitsky
(74) *Attorney, Agent, or Firm* — Amin, Turocy & Watson, LLP

(57) ABSTRACT

According to one embodiment, an image forming device includes a fixing device and a controller. The controller obtains an identifier for identifying a user. The controller controls the fixing device based on the obtained identifier, history information, and temperature information, to be a fixing temperature associated with usage status information associated with the obtained identifier. The history information is information obtained by associating the identifier and the usage status information. The usage status information is information including a printing ratio in previous image formation by a user. The temperature information is information obtained by associating the usage status information and the fixing temperature.

7 Claims, 8 Drawing Sheets

FIG. 5 t1

| EXECUTION DATE AND TIME | USER ID | COPY/PRINT | COLOR/ MONOCHROME | SOLID/HALFTONE | TYPE OF SHEET | NUMBER OF SHEETS [SHEETS] | PRINTING RATIO [%] |
|---|---|---|---|---|---|---|---|
| 2020/1/15 10:03 | A015 | COPY | MONOCHROME | SOLID | PLAIN PAPER | 5 | 15 |
| 2020/1/15 10:08 | B002 | COPY | COLOR | HALFTONE | PLAIN PAPER | 3 | 50 |
| 2020/1/15 10:15 | A008 | PRINT | COLOR | HALFTONE | PLAIN PAPER | 8 | 70 |
| ⋮ | ⋮ | ⋮ | ⋮ | ⋮ | ⋮ | ⋮ | ⋮ |

FIG. 6 t2

| USER ID | AVERAGE PRINTING RATIO [%] |
|---|---|
| A015 | 20 |
| B002 | 45 |
| A008 | 75 |
| ⋮ | ⋮ |

FIG. 7 t3

| PRINTING RATIO [%] | FIXING TEMPERATURE [℃] |
|---|---|
| 0～20 | 150 |
| 21～50 | 165 |
| 51～80 | 175 |
| 81～100 | 180 |

FIG. 9 t2a

| USER ID | AVERAGE NUMBER OF SHEETS [SHEETS] | AVERAGE PRINTING RATIO [%] |
|---|---|---|
| A015 | 4 | 20 |
| B002 | 2 | 45 |
| A008 | 10 | 75 |
| ⋮ | ⋮ | ⋮ |

FIG. 10 t3a

| FIXING TEMPERATURE [℃] | | NUMBER OF SHEETS [SHEETS] | | | | |
|---|---|---|---|---|---|---|
| | | 1～2 | 3～5 | 6～10 | 10～20 | 21 OR MORE |
| PRINTING RATIO [%] | 0～20 | 150 | 150 | 150 | 155 | 160 |
| | 21～50 | 165 | 165 | 170 | 170 | 175 |
| | 51～80 | 175 | 180 | 180 | 180 | 185 |
| | 81～100 | 180 | 185 | 185 | 190 | 190 |

IMAGE FORMING DEVICE, IMAGE FORMING SYSTEM, IMAGE FORMING METHOD, AND NON-TRANSITORY RECORDING MEDIUM STORING IMAGE FORMING PROGRAM

FIELD

Embodiments described herein relate generally to an image forming device, an image forming system, an image forming method, and a non-transitory recording medium storing an image forming program.

BACKGROUND

There is an image forming device such as a multifunction peripheral (MFP) or the like that fixes toner to a sheet by heat generated by a heater. At the time of startup, the image forming device heats a fixing device to a fixing temperature as warm-up. When the image forming device receives a job (hereinafter, referred to as an "image formation job") for performing an image forming process such as printing or copying, the fixing device is warmed up in advance to the fixing temperature. The image forming device can start a fixing process without making the user wait.

The proper fixing temperature varies depending on the printing ratio of the formed image, the number of sheets on which images are formed, and the like. The printing ratio of the formed image means a percentage of an area of the page to be covered with toner versus the entire area of the page, i.e., a page coverage. The image forming device can perform the fixing process at a lower fixing temperature, for example, in a case where an image is formed at a low printing ratio, compared with a case where an image is formed at a high printing ratio. There is a demand for reduction of power consumption in the image forming device, and it is desirable to perform the fixing process at a lower fixing temperature.

A mismatch may occur between the fixing temperature during warm-up and the printing ratio of an image formed based on an image forming job. When the fixing temperature during warm-up is set relatively high but the printing ratio of an image formed based on an image forming job is low, power is wasted due to an excessive heating process. When the fixing temperature at the time of warm-up is set relatively low but the printing ratio of the image formed based on the image forming job is high, it requires more time before starting the fixing process in order to further heat the fixing unit to the required fixing temperature, and thus the user has to wait for a longer period of time. It is difficult to achieve both reduction in power consumption and reduction in a user's standby time.

DESCRIPTION OF THE DRAWINGS

FIG. 5 is a diagram illustrating an example of a history information table;

FIG. 6 is a diagram illustrating an example of an average value information table;

FIG. 7 is a diagram illustrating an example of a temperature information table;

FIG. 9 is a diagram illustrating an example of an average value information table; and FIG. 10 is a diagram illustrating an example of a temperature information table.

DETAILED DESCRIPTION

A consequence of an exemplary embodiment is to provide an image forming device that can reduce a user's standby time while reducing power consumption, an image forming system, an image forming method, and a non-transitory recording medium for storing an image forming program.

In general, according to one embodiment, an image forming device includes a fixing device and a controller. The controller obtains an identifier for identifying a user. The controller controls a fixing device to be a fixing temperature associated with usage status information associated with the obtained identifier based on the obtained identifier, history information, and temperature information. The history information is information obtained by associating the identifier and the usage status information. The usage status information is information including a printing ratio in previous image formation by the user. The temperature information is information obtained by associating the usage status information and the fixing temperature.

Hereinafter, an image forming device, an image forming system, an image forming method, and a non-transitory recording medium for storing an image forming program according to the embodiment are described with reference to the drawings.

First Embodiment

Figure 1:
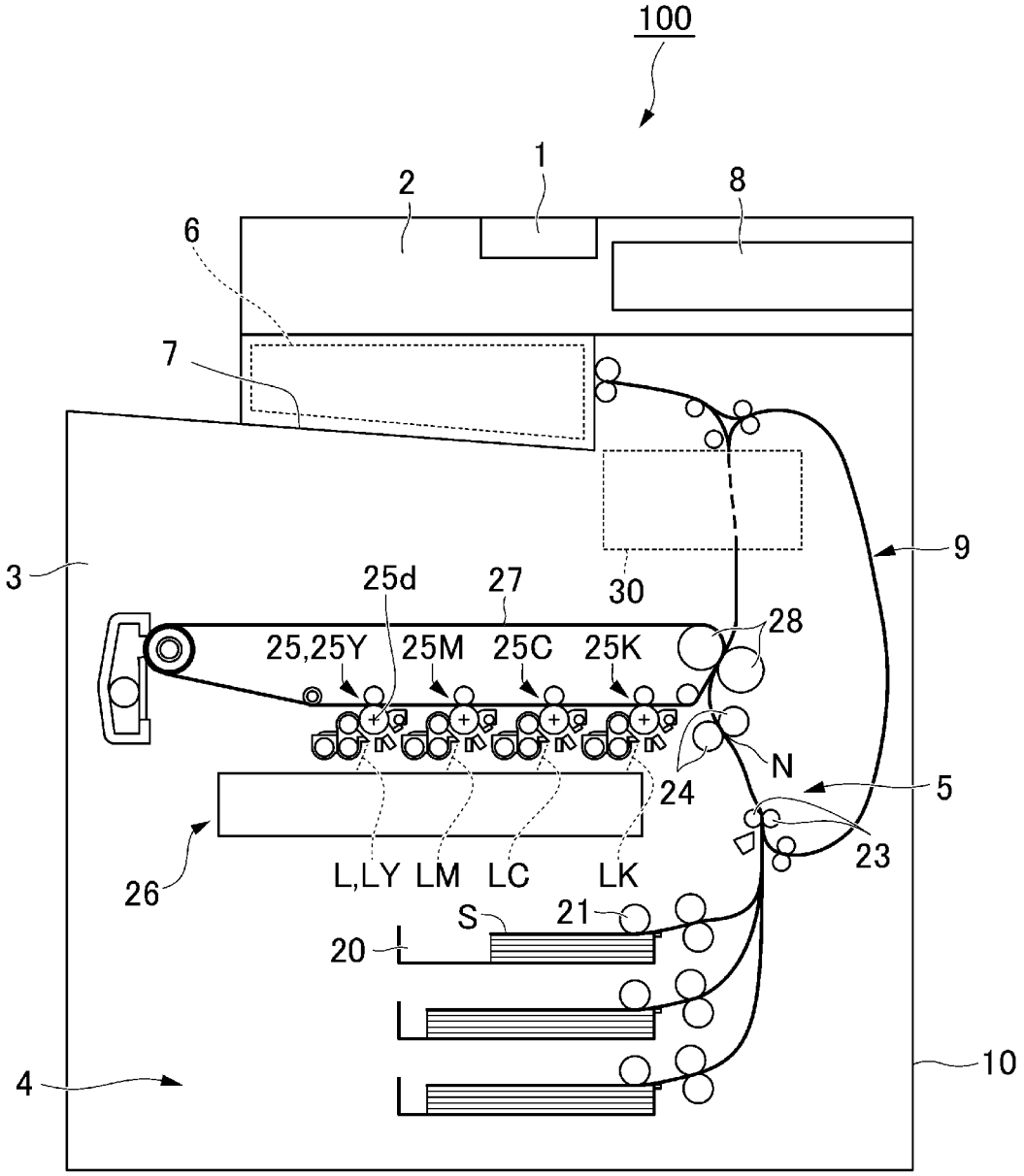
FIG. 1 is a schematic diagram of a configuration of an image forming device.

FIG. 1 is a schematic diagram of a configuration of an image forming device.

An image forming device 100 is, for example, a multifunction peripheral (MFP). The image forming device 100 forms an image on a sheet S with a developer such as toner. The sheet S is, for example, paper or a label sheet. The sheet S may be any product as long as the image forming device 100 can form an image on the surface thereof.

The image forming device 100 includes a housing 10, a display 1, a scanner unit 2, an image forming unit 3, a sheet supply unit 4, a conveyance unit 5, a discharge tray 7, an inversion unit 6, a control panel 8, and a controller 9.

The housing 10 forms an appearance of the image forming device 100.

The display 1 is an image display device such as a liquid crystal display or an organic electroluminescence (EL) display. The display 1 displays various kinds of information relating to the image forming device 100.

The scanner unit 2 reads image information of a reading target based on brightness and darkness of light. The scanner unit 2 records the read image information. The scanner unit 2 outputs the generated image information to the image forming unit 3. The recorded image information may be transmitted to another information processing device via the network.

The image forming unit 3 forms an output image (hereinafter, referred to as a "toner image") with a developer such as toner based on image information received from the scanner unit 2 or image information received from an external device. The image forming unit 3 transfers the toner image to the surface of the sheet S. The image forming unit 3 heats and presses the toner image on the surface of the sheet S and fixes the toner image to the sheet S. The sheet S may be a sheet supplied by the sheet supply unit 4 or may be a manually fed sheet.

The sheet supply unit 4 supplies the sheets S to the conveyance unit 5 one by one according to timing for the image forming unit 3 to form a toner image. The sheet supply unit 4 includes a sheet storage unit 20 and a pickup roller 21.

The sheet storage unit 20 stores the sheets S having a predetermined size and type.

The pickup roller 21 picks up the sheets S from the sheet storage unit 20 one by one. The pickup roller 21 supplies the picked-up sheets S to the conveyance unit 5.

The conveyance unit 5 conveys the sheets S supplied from the sheet supply unit 4 to the image forming unit 3. The conveyance unit 5 includes conveyance rollers 23 and registration rollers 24.

The conveyance rollers 23 convey the sheets S supplied from the pickup rollers 21 to the registration rollers 24. The conveyance rollers 23 cause the leading end of the sheet S in the conveyance direction to abut a nip N of the registration rollers 24.

The registration roller 24 adjusts the position of the leading end of the sheet S in the conveyance direction by bending the sheet S at the nip N. The registration rollers 24 convey the sheet S according to the timing at which the image forming unit 3 transfers a toner image to the sheet S.

Hereinafter, the image forming unit 3 is described.

The image forming unit 3 includes a plurality of image forming parts 25, a laser deflection unit 26, an intermediate transfer belt 27, a transfer unit 28, and a fixing device 30.

The image forming parts 25 include photosensitive drums 25*d*. The image forming parts 25 form toner images according to the image information from the scanner unit 2 or an external device on the photosensitive drums 25*d*. A plurality of an image forming part 25Y, an image forming part 25M, an image forming part 25C, and an image forming part 25K form toner images by yellow, magenta, cyan, and black toners, respectively.

Chargers, developing devices, and the like are arranged around the photoconductor drums 25*d*. The chargers charge the surfaces of the photosensitive drums 25*d*. The developing devices contain developers including yellow, magenta, cyan, and black toners. The developing devices develop electrostatic latent images on the photosensitive drums 25*d*. As a result, the toner images by toner of a color are formed on the photosensitive drums 25*d*.

The laser deflection unit 26 deflects laser beams L to the charged photosensitive drums 25*d* and exposes the photosensitive drums 25*d*. The laser deflection unit 26 exposes the photosensitive drums 25*d* of the image forming part 25Y, the image forming part 25M, the image forming part 25C, and the image forming part 25K for respective colors to respective laser beams LY, LM, LC, and LK, to form electrostatic latent images on the photosensitive drums 25*d*.

The toner images on the surface of the photosensitive drum 25*d* are primarily transferred to the intermediate transfer belt 27.

The transfer unit 28 transfers the toner images primarily transferred onto the intermediate transfer belt 27 to the surface of the sheet S at a secondary transfer position.

The fixing device 30 heats and presses the toner image transferred to the sheet S and fixes the toner image to the sheet S.

The inversion unit 6 inverts the sheet S for forming an image on the back surface of the sheet S. The inversion unit 6 inverts the sheet S discharged from the fixing device 30 front to back by switchback. The inversion unit 6 conveys the inverted sheet S to the registration roller 24.

The discharge tray 7 places the sheet S discharged with an image formed.

The control panel 8 includes a plurality of buttons. The control panel 8 receives a user operation. For example, the control panel 8 receives an operation for performing a user certification process (hereinafter, referred to as "user certification") and an operation for forming an image. The control panel 8 outputs a signal according to the operation performed by the user to the controller 9 of the image forming device 100. The display 1 and the control panel 8 may be configured as an integrated touch panel.

The controller 9 controls each unit of the image forming device 100. The controller 9 performs user certification to the user using the image forming device 100. The controller 9 specifies an identifier (hereinafter, referred to as a "user ID") for identifying a user. The controller 9 confirms whether to operate the image forming device 100 with the specified user ID. For example, the confirmation is to compare the certification table included in the controller 9 and the user ID. The confirmation is, for example, to ask a certification server connected to the image forming device 100 via the network for certification. If the certification is obtained as a result of the confirmation of the specified user ID, the controller 9 receives an input to the control panel 8, an operation for causing the image forming unit 3 to form a toner image or an operation for causing the scanner unit 2 to read image information.

Any method can be used for specifying the user ID. For example, the user ID is specified when the user inputs an operation to the control panel 8. Otherwise, for example, the user ID is specified when the user puts their IC card over a card reader 11 included in the image forming device 100. Otherwise, for example, the user ID is specified when the user performs a login operation to an external device (for example, a personal computer or a smartphone) connected to the image forming device 100 via the network.

Figure 2:
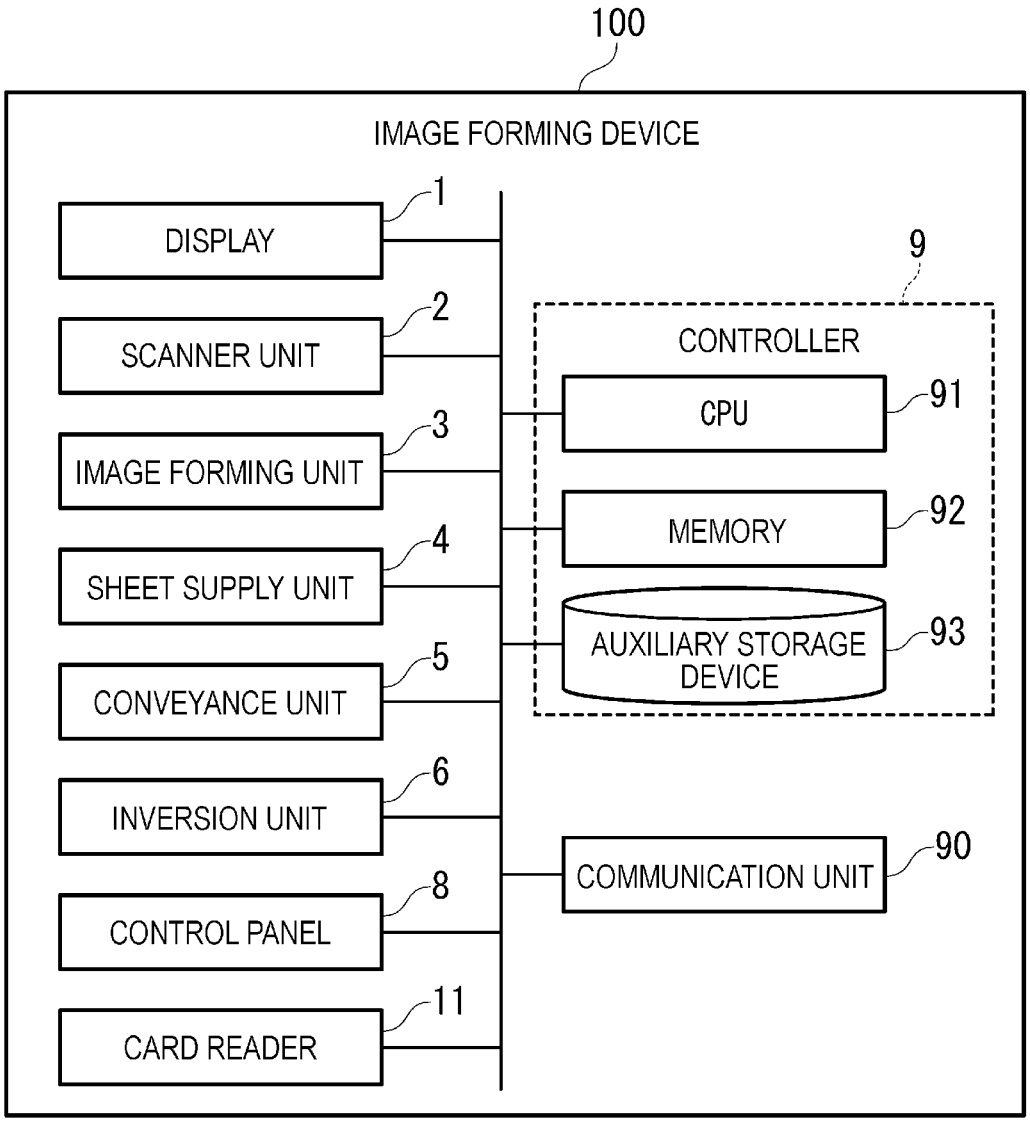
FIG. 2 is a diagram of a hardware configuration of the image forming device.

FIG. 2 is a diagram of a hardware configuration of the image forming device 100. The image forming device 100 includes a central processing unit (CPU) 91, a memory 92, an auxiliary storage device 93, and the like which are connected via buses and executes a program. The image forming device 100 functions as a device including the scanner unit 2, the image forming unit 3, the sheet supply unit 4, the conveyance unit 5, the inversion unit 6, the control panel 8, the card reader 11, and a communication unit 90 by the execution of the program.

The CPU 91 functions as the controller 9 by executing a program stored in the memory 92 and the auxiliary storage device 93. The controller 9 controls an operation of each functional unit of the image forming device 100. The CPU 91 is an example of a processor, and other processors may be used instead of the CPU 91.

The auxiliary storage device 93 is configured by using a storage device such as a magnetic hard disk device or a semiconductor storage device. The auxiliary storage device 93 stores various kinds of information relating to the image forming device 100. The auxiliary storage device 93 records image information read by the scanner unit 2.

The communication unit 90 includes a communication interface for connecting the own device to an external device. The communication unit 90 communicates with an external device via a communication interface. For example, the communication unit 90 obtains information indicating user certification execution instruction output from the external device based on the instruction from the user. For example, the communication unit 90 obtains an image formation job indicating printing execution instruction output from the external device based on the instruction from the user.

Figure 3:
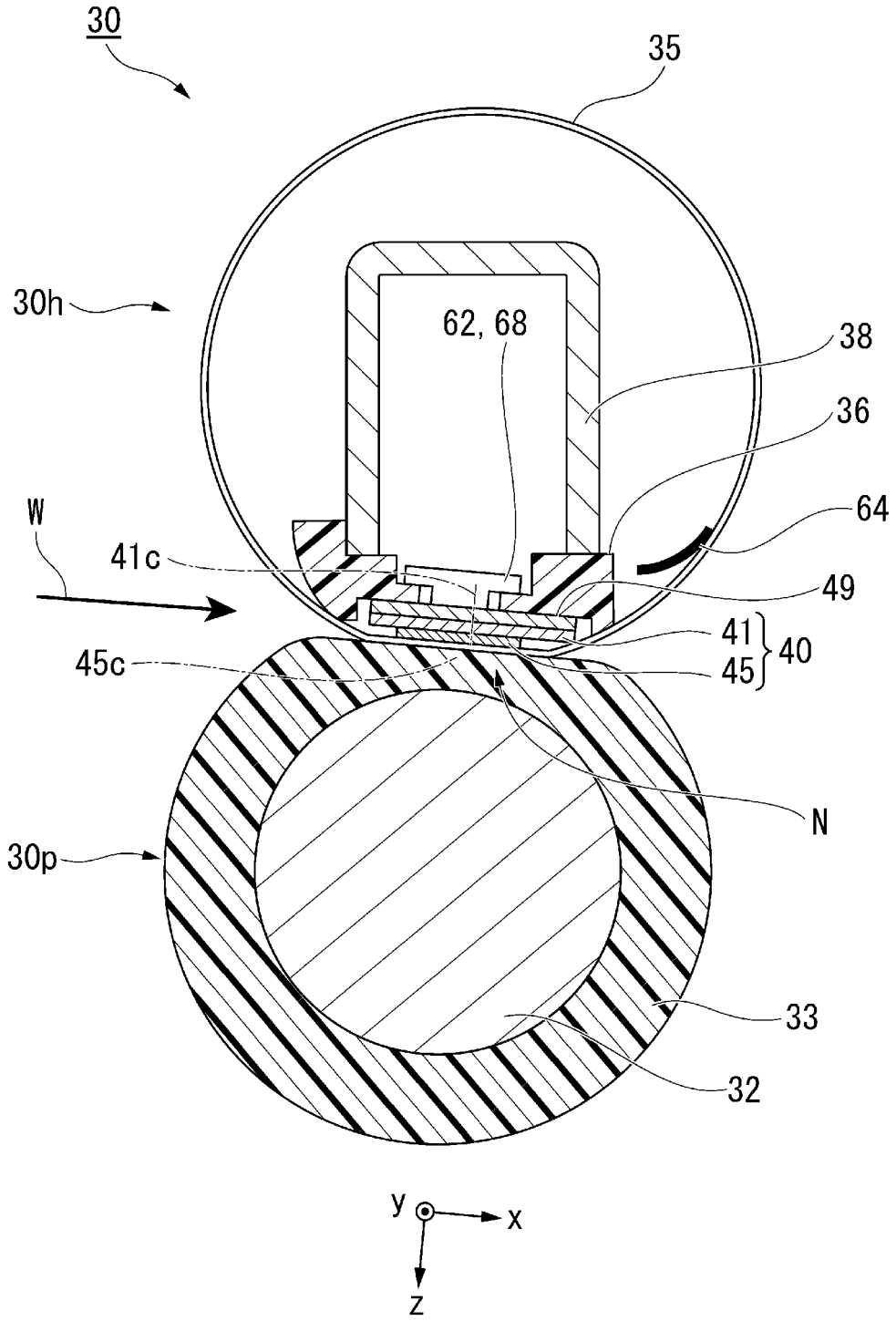
FIG. 3 is a front sectional view of a heating device.

FIG. 3 is a front sectional view of a heating device. The heating device according to the present embodiment is the fixing device 30. The fixing device 30 includes a pressure roller 30*p* and a film unit 30*h*.

The pressure roller 30*p* forms the nip N with the film unit 30*h*. The pressure roller 30*p* presses a toner image of the sheet S that enters the nip N. The pressure roller 30*p* rotates and conveys the sheet S. The pressure roller 30*p* can press the surface against a cylindrical film 35 and can be driven to rotate.

The pressure roller 30*p* can approach and separate from the film unit 30*h*. When the sheet S is jammed in the fixing device 30, the pressure roller 30*p* can separate from the film unit 30*h* so that the sheet S is easily removed. In a state where the rotation of the cylindrical film 35 is stopped in a sleep state or the like, the pressure roller 30*p* is caused to separate from the film unit 30*h*, and thereby plastic deformation of the cylindrical film 35 is prevented.

The pressure roller 30*p* is rotationally driven by a motor. When the pressure roller 30*p* rotates in a state where the nip N is formed, the cylindrical film 35 of the film unit 30*h* is driven and rotated. The pressure roller 30*p* rotates in a state where the sheet S is arranged at the nip N to convey the sheet S in a conveyance direction W.

The film unit 30*h* heats the toner image of the sheet S entering the nip N. The film unit 30*h* includes the cylindrical film 35, a heater unit 40, a heat transfer member 49, a support member 36, a stay 38, a heater thermometer 62, a thermostat 68, and a film thermometer 64.

The cylindrical film 35 is formed in a cylindrical form.

The heater unit 40 is in contact with the inner peripheral surface of the cylindrical film 35.

The heat transfer member 49 is formed of a metal material having high thermal conductivity such as copper. The heat transfer member 49 is in contact with the surface of the heater unit 40 in the −z direction.

The support member 36 is formed of a resin material such as a liquid crystal polymer. The support member 36 covers the heater unit 40 in the −z direction and on both sides in the x direction. The support member 36 supports the heater unit 40 via the heat transfer member 49. The support member 36 supports the inner peripheral surface of the cylindrical film 35 on both end portions of the heater unit 40 in the x direction.

The heat transfer member 49 averages the temperature distribution of the heater unit 40 in order to avoid local melting of the support member 36.

The stay 38 illustrated in FIG. 3 is formed of a steel plate material or the like. The both end portions of the stay 38 in the y direction are fixed to the housing of the image forming device 100 in order to support the film unit 30*h* to the image forming device 100.

The heater thermometer 62 is arranged in the −z direction with respect to the heater unit 40 with the heat transfer member interposed therebetween. For example, the heater thermometer 62 is a thermistor. The heater thermometer 62 is mounted on the surface of the support member 36 in the −z direction. The temperature sensing element of the heater thermometer 62 is in contact with the heat transfer member 49 through a hole that penetrates the support member 36 in the z direction. The heater thermometer 62 measures the temperature of the heater unit 40 via the heat transfer member 49.

The thermostat 68 is arranged in the −z direction with respect to the heater unit 40 with the heat transfer member 49 interposed therebetween. The thermostat 68 cuts off the power to a heater 45 when the temperature of the heater unit detected via the heat transfer member 49 exceeds a predetermined temperature. The plurality of heater thermometers 62 and the plurality of thermostats 68 are arranged alternately along the y direction.

The film thermometer 64 is on the inner side of the cylindrical film 35 and arranged in the +x direction of the heater unit 40. The film thermometer 64 is in contact with the inner peripheral surface of the cylindrical film 35 and measures the temperature of the cylindrical film 35.

Figure 4:
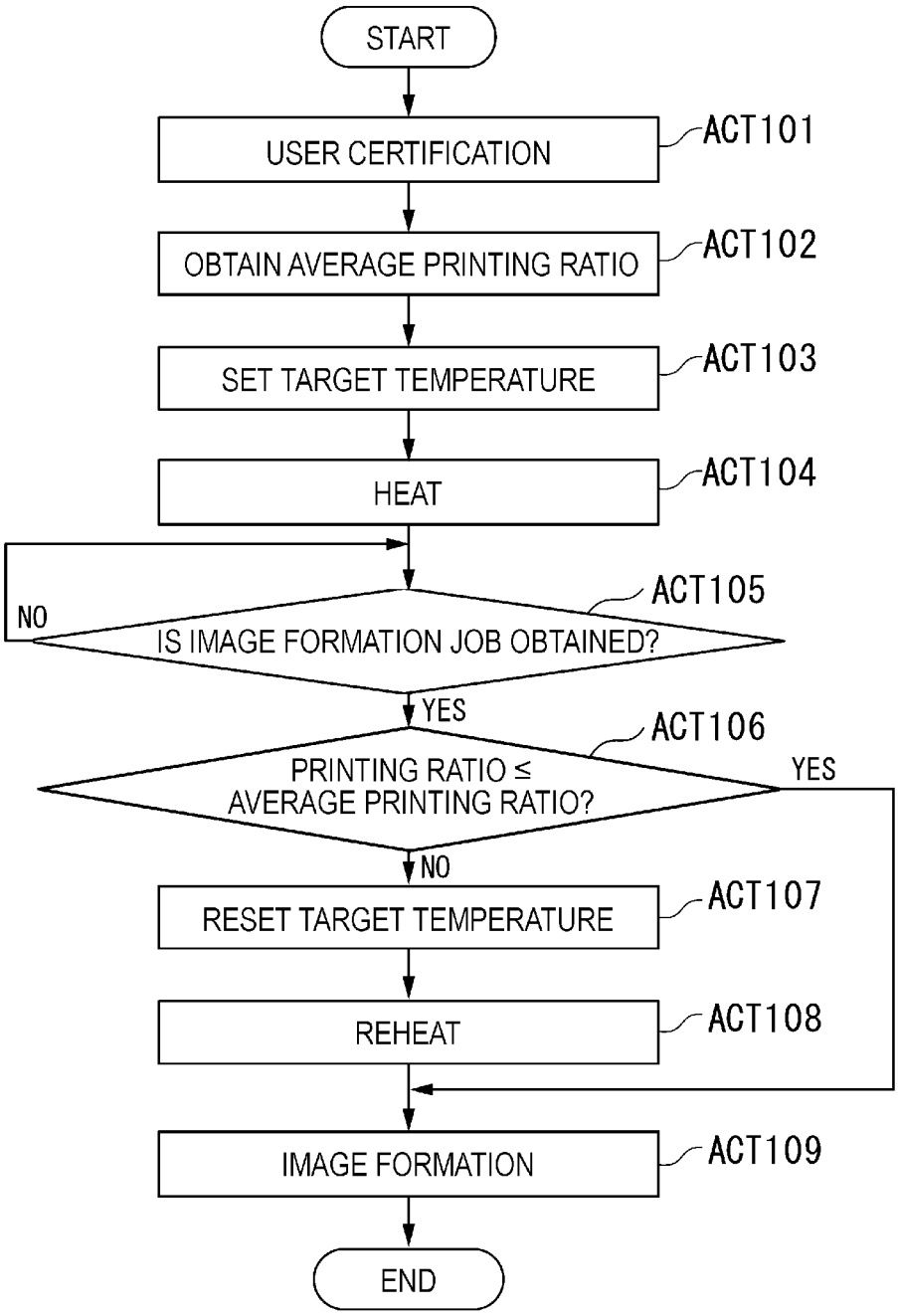
FIG. 4 is a flowchart for describing an operation of a controller.

FIG. 4 is a flowchart for describing an operation of the controller 9.

The controller 9 performs user certification with respect to a user who uses the image forming device 100 (ACT101). The controller 9 performs the user certification to specify the user ID for identifying the certified user.

In the auxiliary storage device 93 of the controller 9, a history information table t1 indicating history of previously executed image formation jobs is stored in advance.

FIG. 5 is a diagram illustrating an example of the history information table t1. The history information table t1 is, for example, data indicating previously executed image formation jobs. In the history information table t1, for example, item values such as "execution date and time", "copy/print", "color/monochrome", "solid/halftone", "type of sheet", "number of sheets", and "printing ratio" are associated with each image formation job.

In the item of "execution date and time", information indicating date and time at which the image formation job is executed is stored.

In the item of "copy/print", information indicating whether the executed image formation job is an image formation job for copying or an image formation job for printing is stored.

In the item of "color/monochrome", information indicating whether the executed image formation job is an image formation job for forming a color image or an image formation job for forming a monochrome image is stored.

In the item of "solid/halftone", information indicating whether the executed image formation job is an image formation job for forming an image by solid coating (hereinafter referred to as "solid") or an image formation job for forming a halftone image is stored. In a case of halftone, information indicating the size of halftone dots may be further stored.

In the item of "type of sheet", information indicating the type of sheet S on which an image is formed by the executed image formation job is stored. For example, types of the sheet S include plain paper, coated paper, matte paper, high-quality paper, Kent paper, Yupo paper, and film paper. Information indicating the size of the sheet S may be further stored. Examples of size of the sheet S include A3 size, B4 size, A4 size, letter size, B5 size, A5 size, 2L size, postcard size, L size, business card size, and card size.

In the item of "number of sheets", a numerical value (unit: [sheet]) indicating the number of the sheets S on which an image is formed by the image formation job is stored.

In the item of "printing ratio", a numerical value indicating a printing ratio (unit: [%]) in the image formation executed with the image formation job is stored. In a case of the image formation job in which images are formed on the plurality of sheets S (that is, if the item value of "the number of sheets" is two or more"), for example, the average value or the maximum value of the printing ratio in the plurality of sheets S and the like are stored.

In the auxiliary storage device 93 of the controller 9, an average value information table t2 indicating information aggregated based on the history information table t1 is stored in advance. The average value information table t2 is generated, for example, at the timing when the history information table t1 is stored in the auxiliary storage device 93 by the controller 9.

FIG. 6 is a diagram illustrating an example of the average value information table t2. The average value information table t2 is, for example, data indicating an average value (hereinafter, referred to as an "average printing ratio") of a printing ratio for each user ID. In the average value information table t2, for example, an item value of "user ID" and an item value of "average printing ratio" are associated with each other. As described above, the item value of the average printing ratio is a value aggregated by using values of printing ratios included in the history information table t1.

The controller 9 refers to the average value information table t2 stored in the auxiliary storage device 93 and obtains an average printing ratio associated with the user ID specified by the user certification of ACT101 (ACT102). For example, in a case of the average value information table t2 illustrated in FIG. 6, if the user ID specified by the user certification of ACT101 is "A015", the value of the obtained average printing ratio is "20 [%]".

In the auxiliary storage device 93 of the controller 9, a temperature information table t3 indicating a proper fixing temperature in the fixing device 30 for each printing ratio is stored in advance. The proper fixing temperature is, for example, a minimum temperature required in the fixing process by the fixing device 30.

FIG. 7 is a diagram illustrating an example of the temperature information table t3. The temperature information table t3 is, for example, data indicating the fixing temperature for each range of the printing ratio. In the temperature information table t3, for example, an item value of "printing ratio" and an item value of "fixing temperature" are associated with each other. The item value of the fixing temperature is, for example, a value determined in advance by an expert or the like based on experience, experiments, and the like.

The controller 9 refers to the temperature information table t3 stored in the auxiliary storage device 93 and obtains the value of the fixing temperature associated with the value of the average printing ratio obtained in ACT102. The controller 9 sets the obtained fixing temperature as a fixing temperature to be a target (hereinafter, referred to as "target temperature") (ACT103). The controller 9 controls a preheating process of the heater 45 to heat the fixing device 30 to a target temperature (ACT104).

The controller 9 waits for an input of an image formation job (ACT105). For example, a user performs an operation input indicating an execution instruction for copying or the like with the control panel 8 so that the image formation job is input to the controller 9. For example, the user performs an operation input indicating an execution instruction such as printing from an external device (for example, a personal computer or a smartphone) connected to the image forming device 100 via the network so that the image formation job is input to the controller 9.

When the image formation job is obtained (ACT105•Yes), the controller 9 refers to a content of the obtained image formation job. The controller 9 specifies the printing ratio in the image formation executed with the corresponding image formation job. The controller 9 compares the specified printing ratio and the average printing ratio obtained in ACT102 (ACT106). When the specified printing ratio is equal to or lower than the printing ratio obtained in ACT102 (ACT106•Yes), the controller 9 maintains the target temperature set in advance and controls the execution of the image formation process (ACT109).

When the specified printing ratio is higher than the printing ratio obtained in ACT102 (ACT106•No), the controller 9 resets the target temperature (ACT107). The controller 9 refers to the temperature information table t3 stored in the auxiliary storage device 93 and obtains the value of the fixing temperature associated with the value of the specified printing ratio. The controller 9 resets the obtained fixing temperature as the target temperature. The controller 9 controls a heating process (reheating) of the heater 45 to heat the fixing device 30 to a target temperature (ACT108). After the reheating is completed, the controller 9 maintains the reset target temperature and controls the execution of the image formation process (ACT109).

In the above, the operations of the controller 9 indicated by the flowchart of FIG. 4 are completed.

As described above, the image forming device 100 according to the first embodiment includes the fixing device 30 and the controller 9. The controller 9 obtains the user ID (identifier) for identifying the user. The controller 9 controls the fixing device 30 to be fixing temperature associated with the printing ratio (usage status information) associated with the obtained user ID based on the obtained user ID, the history information table t1 and the average value information table t2 (history information), and the temperature information table t3 (temperature information). Here, the history information table t1 and the average value information table t2 are information obtained by associating the user ID and the usage status information. The usage status information is information including a printing ratio in the previous image formation by the user. The temperature information table t3 is information obtained by associating the printing ratio and the fixing temperature.

The image forming device 100 according to the first embodiment can predict the printing ratio or the like of the image formed by the input image formation job based on the printing ratio or the like in the previous image formation of each user. The image forming device 100 executes warm-up to be fixing temperature corresponding to the predicted printing ratio or the like. When the printing ratio of the image formed by the actually input image formation job is higher than the predicted printing ratio, the image forming device 100 performs control so that the heater 45 of the fixing device 30 is reheated, if necessary. The image forming device 100 can reduce power consumption by suppressing an excessive heating process and can reduce the user's standby time by executing warm-up.

According to the present embodiment, the controller 9 is configured to determine whether to perform reheating based on the comparison result between the specified printing ratio and the average printing ratio obtained in ACT102. However, the exemplary embodiment is not limited to such a configuration, and the controller 9 may be configured to determine whether to perform reheating based on a comparison result between a target temperature that is set in advance and a fixing temperature associated with the average printing ratio obtained in ACT102. That is, the controller 9 may refer to the temperature information table t3 to specify the fixing temperature associated with the average printing ratio obtained in ACT102 and determine to perform reheating when the specified fixing temperature is higher than the target temperature set in advance.

Second Embodiment

The first embodiment described above has a configuration in which the fixing temperature is determined based on the printing ratio, but the second embodiment described below has a configuration in which the fixing temperature is determined based on the printing ratio and the number of printing sheets. A schematic diagram of a configuration and a diagram of a hardware configuration of the image forming device 100, and a front sectional view of the fixing device 30 according to the second embodiment are the same as those illustrated in FIGS. 1 to 3 referred in the description of the image forming device 100 according to the first embodiment.

Hereinafter, the configuration of the controller 9 is described.

Figure 8:
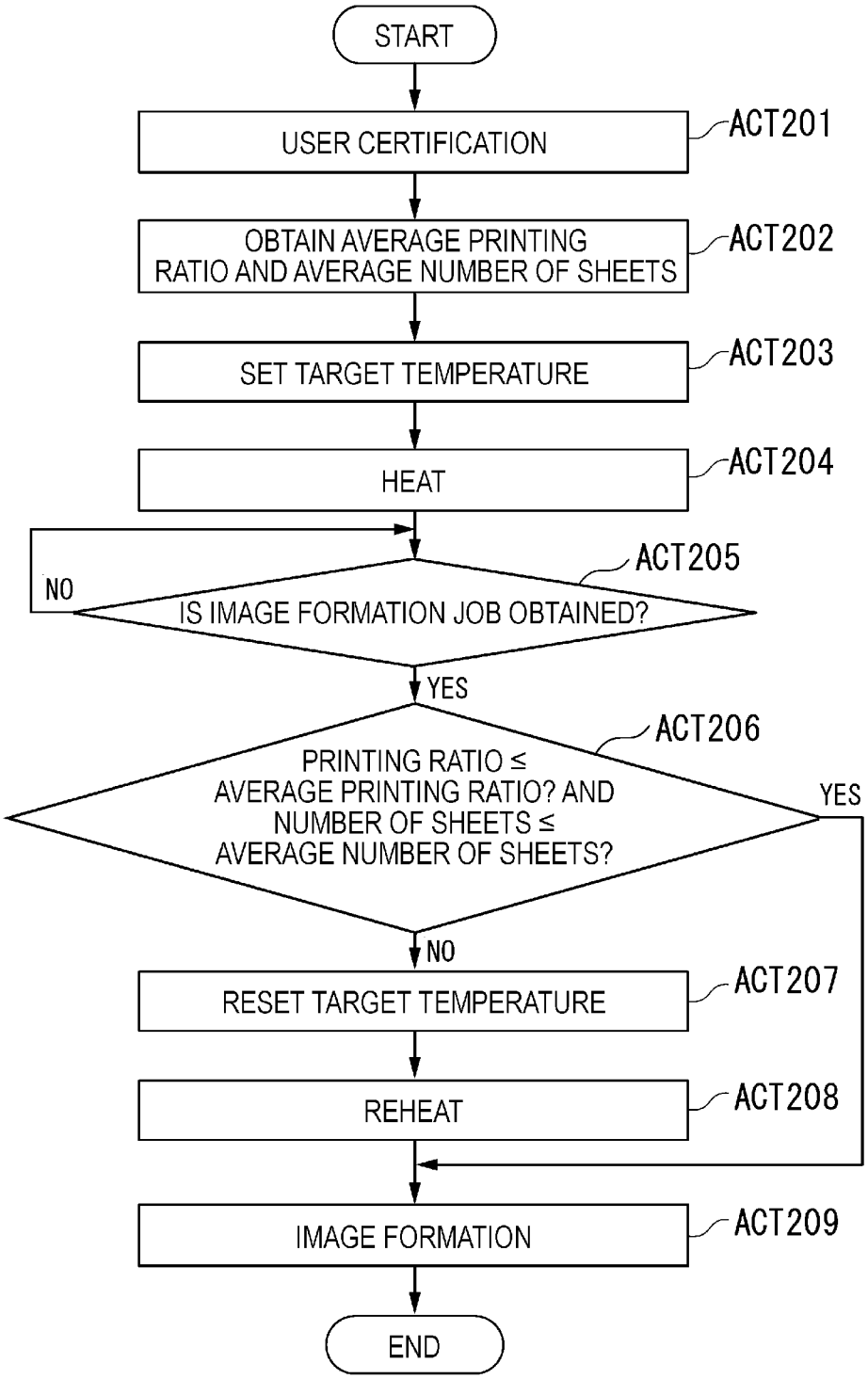
FIG. 8 is a flowchart for describing an operation of the controller.

FIG. 8 is a flowchart for describing an operation of the controller 9.

The controller 9 performs user certification of a user who uses the image forming device 100 (ACT201). The controller 9 specifies the user ID for identifying the certified user by performing the user certification. As the certification method, any method can be used.

In the auxiliary storage device 93 of the controller 9, the history information table t1 indicating history of the previously executed image formation job is stored in advance. The configuration of the history information table t1 may be the same as that of the first embodiment described above.

In the auxiliary storage device 93 of the controller 9, an average value information table t2*a* indicating the information aggregated based on the history information table t1 is stored in advance.

FIG. 9 is a diagram illustrating an example of the average value information table t2*a*. For example, the average value information table t2*a* is data indicating an average value (hereinafter, referred to as an "average number of sheets") of the number per a job of sheets S on which images are formed and an average printing ratio for each user ID.

In the average value information table t2*a*, for example, the item value of "user ID", the item value of "average number of sheets", and the item value of "average printing ratio" are associated with each other. The item value of the average number of sheets and the item value of the average printing ratio are values obtained by respectively aggregating the value of the number of sheets and the value of the printing ratio included in the history information table t1.

The controller 9 refers to the average value information table t2*a* stored in the auxiliary storage device 93 and obtains the average number of sheets and the average printing ratio associated with the user ID specified by the user certification of ACT201 (ACT202). For example, in a case of the average value information table t2*a* illustrated in FIG. 9, if the user ID specified by the user certification of ACT101 is "A015", the value of the obtained average number of sheets and the value of the obtained average printing ratio are respectively "4 [sheets]" and "20[%]".

In the auxiliary storage device 93 of the controller 9, a temperature information table t3*a* indicating the proper fixing temperature in the fixing device 30 for each number of sheets and each printing ratio is stored in advance.

FIG. 10 is a diagram illustrating an example of the temperature information table t3*a*. The temperature information table t3*a* is, for example, data indicating the fixing temperature for each combination of the range of the number of printing sheets and the range of printing ratio. In the temperature information table t3*a*, for example, the combination of the item value of the "number of sheets" and the item value of the "printing ratio" and the item value of the "fixing temperature" are associated with each other.

The controller 9 refers to the temperature information table t3*a* stored in the auxiliary storage device 93 and obtains the value of the fixing temperature associated with the combination of the value of the average number of sheets and the value of the average printing ratio obtained in ACT202. The controller 9 sets the obtained fixing temperature as the target temperature (ACT203). The controller 9 controls the preheating process of the heater 45 to heat the fixing device 30 to be the target temperature (ACT204).

The controller 9 waits for the input of the image formation job (ACT205). When the image formation job is obtained (ACT205•Yes), the controller 9 refers to the content of the obtained image formation job. The controller 9 specifies the number of sheets and the printing ratio in the image formation executed with the corresponding image formation job. The controller 9 compares a specified number of sheets and an average number of sheets obtained in ACT202. The controller 9 compares the specified printing ratio and the average printing ratio obtained in ACT202 (ACT206).

When the specified number of sheets is equal to or lower than the average number of sheets obtained in ACT202, and the specified printing ratio is equal to or lower than the average printing ratio obtained in ACT202 (ACT206•Yes), the controller 9 maintains the target temperature set in advance and controls the execution of the image formation process (ACT209).

When the specified number of sheets is larger than the average number of sheets obtained in ACT202, or the specified printing ratio is higher than the average printing ratio obtained in ACT202 (ACT206•No), the controller 9 resets the target temperature (ACT207). The controller 9 refers to the temperature information table t3*a* stored in the auxiliary storage device 93 and obtains the value of the fixing temperature associated with the combination of the value of the specified number of sheets and the value of the printing ratio. The controller 9 resets the obtained fixing temperature as the target temperature. The controller 9 controls the heating process (reheating) of the heater 45 to heat the fixing device 30 to the target temperature (ACT208). After the reheating is completed, the controller 9 maintains the reset target temperature and controls the execution of the image formation process (ACT209).

In the above, the operations of the controller 9 described by the flowchart of FIG. 8 are completed.

As described above, the average value information table t2*a* according to the second embodiment is, for example, data obtained by associating an average number of sheets and an average printing ratio for each user. The temperature information table t3*a* according to the second embodiment is, for example, data indicating the fixing temperature for each combination of the number of sheets and the printing ratio.

The image forming device 100 according to the second embodiment can predict the number of sheets and the printing ratio of the image formed by the input image formation job based on the number of sheets and the printing ratio of the previous image formation of each user. The image forming device 100 executes warm-up to be the fixing temperature according to the combination of the predicted number of sheets and the predicted printing ratio. When at least one of the case where the number of sheets on which images are formed by the actually input image formation job is larger than the predicted number of sheets and the case where the printing ratio of the image formed by the actually input image formation job is larger than the predicted printing ratio is satisfied, the image forming device 100 performs control so that the heater 45 of the fixing device 30 is reheated, if necessary. The image forming device 100 can reduce power consumption by suppressing an excessive heating process and can reduce the user's standby time by executing warm-up.

Even when the upper limit of the power that can be used by the fixing device during the warm-up of the image forming device is limited, according to the image forming apparatus 100 in the first and second embodiments, the heat process can be performed by using power equal to or less than the upper limit of the available power, and thus the user's standby time can be reduced while reducing power consumption.

According to the first and second embodiments, the fixing temperature is determined based on the average printing ratio, but there may be a configuration in which the fixing temperature is determined based on the further combination of information indicating other tendencies of the image formation by each user. The other tendencies here are, for example, tendencies of the type of the sheet, color or monochrome, solid or halftone, and the like. For example, when the user certification of the user who is highly likely to perform image formation on gloss paper is performed, the target temperature may be set to be higher than when the user certification of the user who is highly likely to perform image formation on plain paper is performed. For example, when the user certification of the user who is highly likely to perform color image formation is performed, the target temperature may be set to be higher than when the user certification of the user who is highly likely to perform monochrome image formation is performed. For example, when the user certification of the user who is highly likely to perform solid image formation is performed, the target temperature may be set to be higher than when the user certification of the user who is highly likely to perform halftone image formation is performed.

The average value information table t2 (or the average value information table t2*a*) and the temperature information table t3 (the temperature information table t3*a*) may be configured to be stored in the auxiliary storage device 93 as respectively independent tables of a case of the image formation job for copying and a case of the image formation job for printing. Even in the case of the same user, the fixing temperature can be determined in consideration of the different image formation tendencies in a case of copying and in a case of printing, and thus the reduction of the user's standby time can be expected while further reducing power consumption.

When the user certification of a user who is highly likely to continuously input an image formation job is performed, the fixing temperature may be set to be higher than when user certification of a user who is less likely to continuously input an image formation job is performed.

When the user certification of a user whose previously executed image formation job has relatively large variation in the printing ratio is performed, the fixing temperature may be set to be higher than when the user certification of a user whose previously executed image formation job has relatively small variation in the printing ratio is performed.

If the target value for power saving is set in advance, until the reduced power consumption reaches the target value, the target temperature may be set to a lower target temperature so that power saving is promoted, and after reduced power consumption reaches the target value, the target temperature may be set to a higher target temperature so that the user's standby time is further reduced.

According to the first and second embodiments, the controller 9 executes the user certification, but there may be a configuration in which an external device performs the user certification.

According to the first and second embodiments, the history information table t1, the average value information table t2 (or the average value information table t2*a*), and the temperature information table t3 (or the temperature information table t3*a*) are stored in the auxiliary storage device 93 of the controller 9, but all or a portion of these tables may be stored in an external device (for example, a server). In this case, a configuration in which the table stored in the external device is available for the plurality of image forming devices 100 is considered. Here, in this case, since the proper fixing temperature may be different for each machine of the image forming device 100, it is preferable that a table is prepared for each machine.

All or a portion of the functions of the image forming device 100 may be realized by using hardware such as an application specific integrated circuit (ASIC), a programmable logic device (PLD), or a field programmable gate array (FPGA). The program may be recorded in a computer-readable recording medium. For example, the computer-readable recording medium is a portable medium such as a flexible disk, a magneto-optical disk, a ROM, or a CD-ROM, or a storage device such as a hard disk built in a computer system. The program may be transmitted via a telecommunication line.

According to the first and second embodiments, the controller 9 is a software function unit, but may be a hardware function unit such as an LSI.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming device, comprising:
- a fixing device; and
- a controller configured
  - to obtain
    - an identifier for identifying a user and
    - an image formation job, and
  - to control the fixing device
    - based on
      - the identifier,
      - history information associated with the identifier and
      - usage status information including
        - a printing ratio in previous image formations by the user, and
        - temperature information associated with the usage status information and a preheating temperature,
    - to be the preheating temperature associated with the usage status information associated with the identifier, and
    - to be a fixing temperature higher than the preheating temperature if
      - a printing ratio of the image formation job is higher than a printing ratio based on the usage status information associated with the identifier.

2. The image forming device according to claim 1, wherein the printing ratio is an average value of printing ratios in previous image formations by the user.

3. The image forming device according to claim 1, wherein the usage status information further includes an average value of the number of printed sheets in previous image formations by the user.

4. The image forming device according to claim 1, wherein the usage status information further includes information indicating a kind of sheet used in previous image formations by the user.

5. The image forming device according to claim 1, wherein the fixing temperature included in the temperature information is a temperature that fixes an image of the printing ratio associated with the corresponding fixing temperature.

6. The image forming device according to claim 1, wherein the usage status information further includes an average number of sheets per a job, and the controller controls the fixing device to be a fixing temperature higher than the preheating temperature if a number of sheets to print indicated in the image formation job is higher than the average number of sheets per a job.

7. The image forming device according to claim 1, wherein the controller obtains an image formation job, specifies a fixing temperature associated with a printing ratio indicated by the corresponding image formation job based on the temperature information, and controls a fixing temperature of the fixing device to be higher when the specified fixing temperature is higher than the fixing temperature of the fixing device controlled based on the identifier.

* * * * *